US006490794B1

(12) United States Patent
Luttrell

(10) Patent No.: US 6,490,794 B1
(45) Date of Patent: Dec. 10, 2002

(54) DISPOSABLE TAMPER RESISTANT RAZOR

(76) Inventor: Mark Luttrell, P.O. Box 109, N. Main #390, Memphis, TN (US) 38103

( * ) Notice: Subject to any disclaimer, the term of this patent is extended or adjusted under 35 U.S.C. 154(b) by 0 days.

(21) Appl. No.: 09/653,854

(22) Filed: Sep. 1, 2000

(51) Int. Cl.[7] ..... B26B 21/54

(52) U.S. Cl. ..... 30/32; 30/50; 30/299; 30/346.58

(58) Field of Search ..... 30/526, 32, 34.2, 30/50, 49, 41, 346.55, 346.56, 299, 329, 309, 246.58, 53

(56) References Cited

U.S. PATENT DOCUMENTS 1,992,517 A * 2/1935 Watson ..... 30/299
4,621,424 A * 11/1986 Jacobson ..... 30/41
5,205,040 A * 4/1993 Werner ..... 30/346.56

* cited by examiner

*Primary Examiner*—Douglas D. Watts

(57) ABSTRACT

A disposable shaving razor comprising a plurality of small blades secured in coplanar relation with one another and forming a continuous edge. The blades are supported in coplanar relation by first and second grips positioned on opposite sides of the blades and urged in pressed abutment therewith. The grips partially form a slot in which the blades are received. Each blade includes a planar body and an engagement member extending from the planar body in angular relation thereto. The first grip defines a channel in which the engagement members are received to lock the plurality of blades within the slot. The present invention is intended for use primarily in penal institutions to minimize the use of the razor as a weapon.

16 Claims, 3 Drawing Sheets

Fig. 1
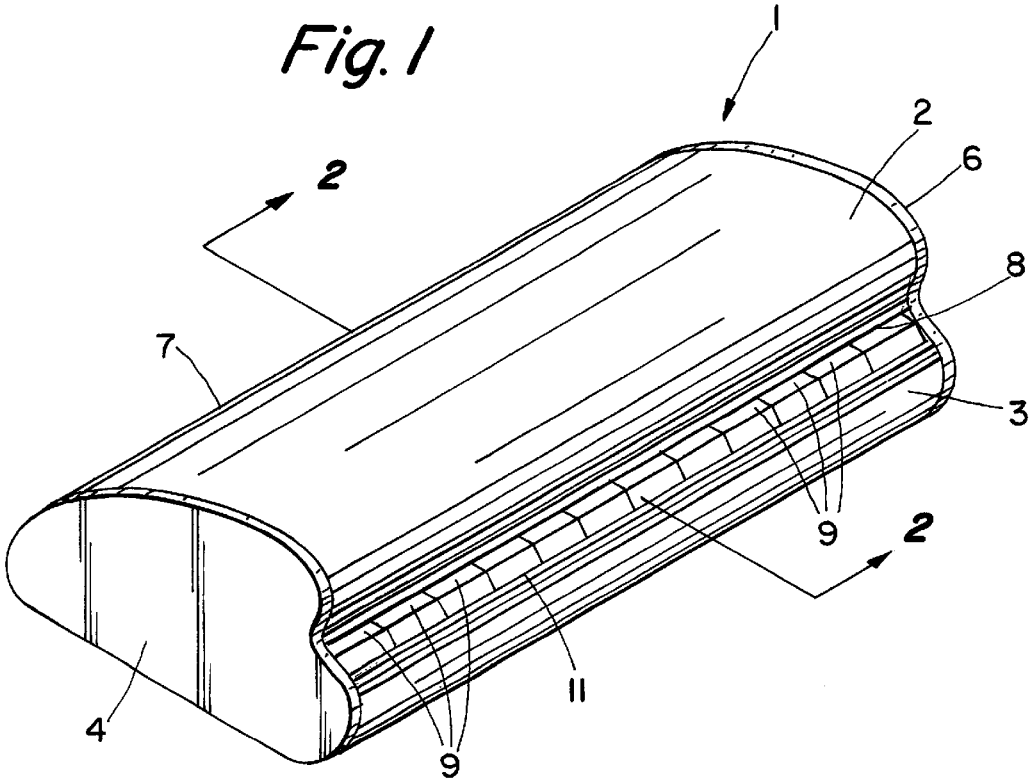
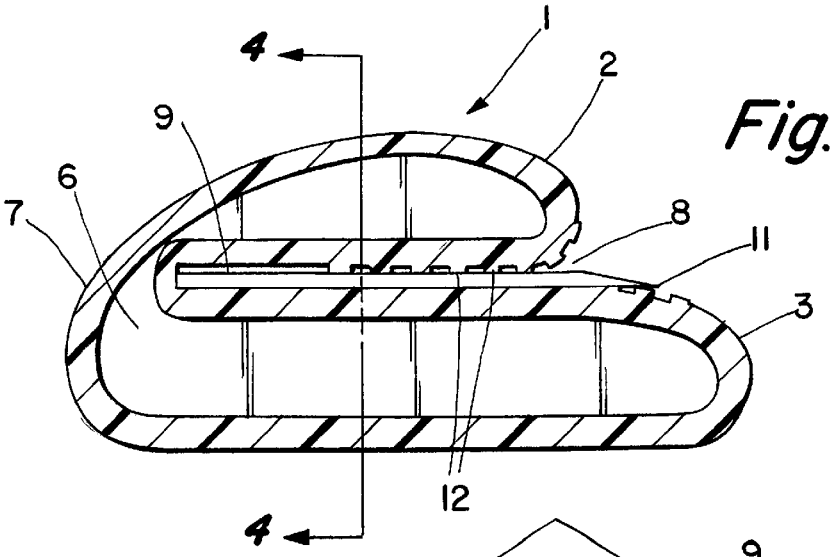
Fig. 2
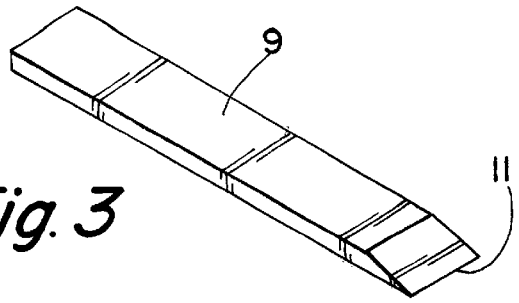
Fig. 3

DISPOSABLE TAMPER RESISTANT RAZOR

FIELD OF THE INVENTION

The present invention relates to disposable razors. More particularity the present invention relates to manual razor heads which may be permanently or detachably connected to a razor handle. In even greater particularity the present invention relates to disposable shaving razors having a continuous cutting edge contained in a razor head or frame. And in even greater particularity the present invention to disposable shaving razor having a continuous cutting edge supported within a razor head or frame wherein removal of the cutting edge from the razor head or frame will eliminate the cutting characteristics of the cutting edge.

BACKGROUND OF THE INVENTION

The disposable razor head is a commonly known device typically comprised of one or more cutting edges or blades mounted within a plastic frame. The disposable razor heads are commonly attached to a handle. The cutting edges or blades typically co-extend the frame and are approximately an inch in length. Many disposable razors have two cutting edges. The edges themselves are disposed in space parallel relation with each cutting edge functioning separately.

Such disposable razors are the norm and have been commonly provided to incarcerated criminals or institutionalized mental patients as a means for shaving. As one might imagine, the human mentality quickly realized that a disposable razor could be disassembled by cracking the frame and removing the separate cutting edges or blades. As the blades are approximately an inch long and razor sharp, these blades are commonly reattached to a handle and used as weapons or a means for inflicting self-harm.

What is needed is a disposable razor head having a razor edge that can be used for shaving that will resist tampering wherein the removal of the cutting blade from the frame will cause the cutting edge to disintegrate and thus prevent the reuse of the cutting edge as a weapon.

SUMMARY OF THE INVENTION

It is the principle object of the present invention to provide a disposable shaving razor head for use in a penal or institutional environment that cannot be used as a weapon or means for inflicting self-harm.

In support of the principal object, another object of the present invention is to provide a disposable shaving razor wherein removal of the cutting edge from the frame will cause the cutting edge to disintegrate.

Another object of the present invention is to provide a disposable shaving razor that meets the foregoing objectives while providing a continuous cutting edge for maximum shaving efficiency.

These and other objects and advantages of the present invention are accomplished through the use of a plurality of tiny blades supported in coplanar arrangement within a plastic case such that the cutting edge of each blade is maintained in substantially linear alignment with the cutting edges of the other blades to form a continuous cutting edge. The case would physically grip the blades in such a manner that destruction of the case in an effort to remove the blades would cause the tiny blades to separate and become dysfunctional as a continuous cutting edge. The case includes first and second grip members held in pressed abutment with the blades. A backplate is connected to the first and second grip members and together therewith forms a slot in which the blades are received. The blades are positioned in abutment with the backplate with the cutting edges defined by each blade positioned in substantially linear alignment. Each blade may define an engagement member which can be received in an engagement channel defined by the case to lock the blades within the slot. Ridges may also be defined on the interior of the slot to maximize gripping contact with the blades.

BRIEF DESCRIPTION OF THE DRAWINGS

Apparatus embodying features of the present invention are depicted in the accompanying drawings to form a portion of this disclosure and wherein:

FIG. 1 is a perspective view of a preferred embodiment of the present invention;

FIG. 2 is a sectional view taken along line 2—2 of FIG. 1;

FIG. 3 is a perspective view of a blade;

DESCRIPTION OF A PREFERRED EMBODIMENT

Figure 4:
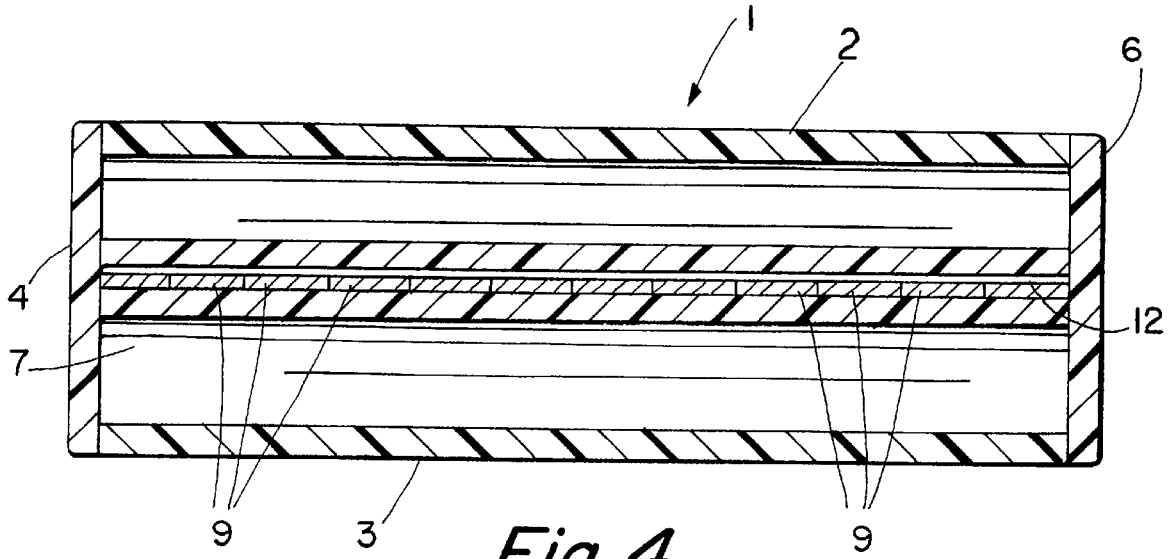
FIG. 4 is a sectional view taken along line 4—4 of FIG. 2.

Referring to the drawings for a clearer understanding of the invention, it should be noted in FIGS. 1 through 4 that a first embodiment of the present invention contemplates the use of an elongated case 1. The case 1 is preferably constructed of harden plastic for strength but having some elasticity. The case can be constructed as one molded piece or several separate pieces inherently joined using methods commonly known in the industry. The case 1 comprises a first grip 2 and the second grip 3. The first and second grips 2 and 3 are mounted and spaced parallel relation by a first end member 4 and the second end member 6 connect to corresponding first and second ends of the first and second grips 2 and 3. The case also includes a backplate 7 intricately connected to the first and second grips 2 and 3. The backplate 7, first grip 2, second grip 3, first end member 4 and second end member 6 together form a slot 8 in which a plurality of blades 9 are received. The first and second grips 2 and 3 are spaced a distance less than the thickness of the blades 9 and are accordingly urged in pressed abutment with the blades 9 by the elastic nature of the case. When the blades 9 are secured in coplanar relation with one another by the first and second grip 2 and 3, the blades 9 are urged in abutment with the backplate 7 which effectively maintains the blades 9 in alignment such that a cutting edge 11 defined by each blade opposite the backplate 7 is maintained in substantially linear alignment with the cutting edges 11 of the other blades 9. The first and second grips 2 and 3 form a plurality of ridges 12 thereon which assist in gripping the plurality of blades 9. The blades 9 are positioned side by side between the first and second end members 4 and 6 such that the close proximity of the blades 9 to one another and the endcap 4 and 6 help maintain the blades 9 in coplanar position.

Figure 5:
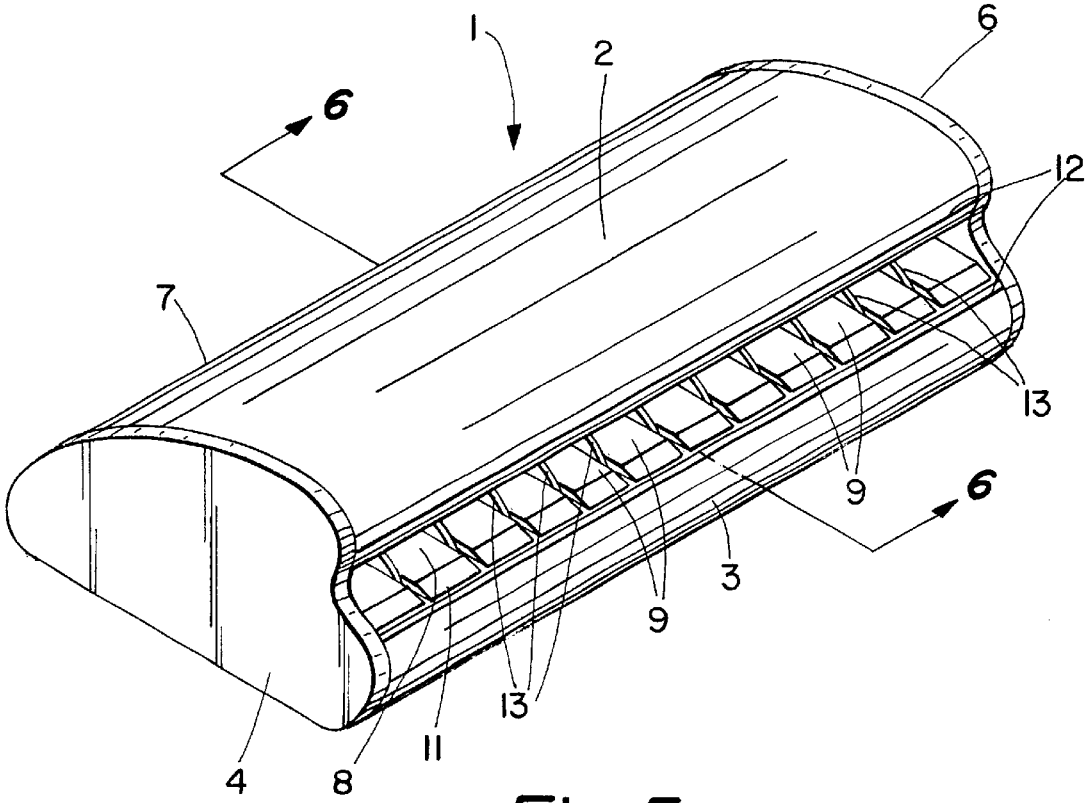
FIG. 5 is a perspective view of an alternate embodiment of the present invention.
Figure 6:
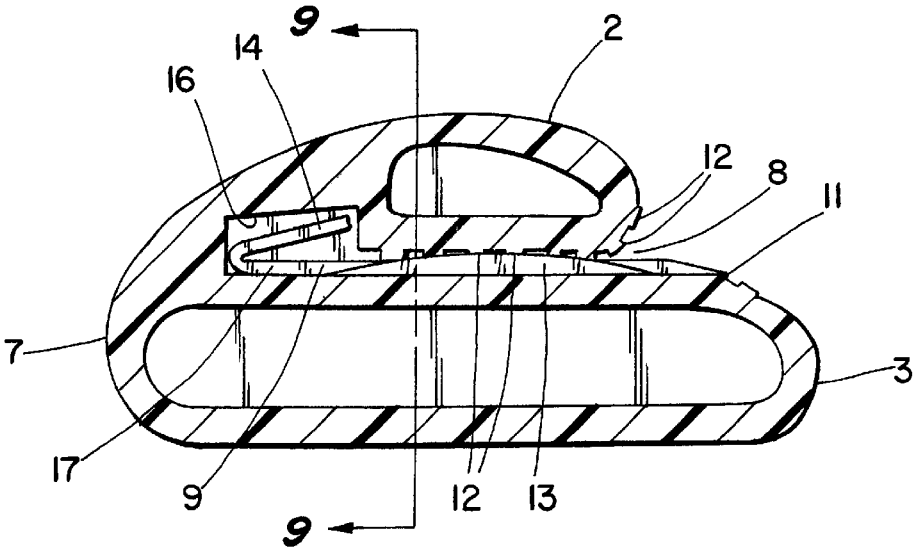
FIG. 6 is a sectional view taken along line 6—6 of FIG. 5.
Figure 7:
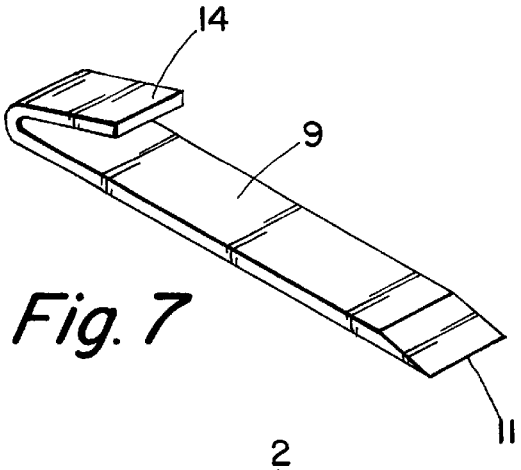
FIG. 7 is a perspective view of an alternate blade.
Figure 8:
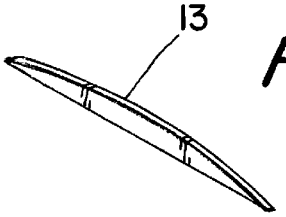
FIG. 8 is a perspective view of a spacer.
Figure 9:
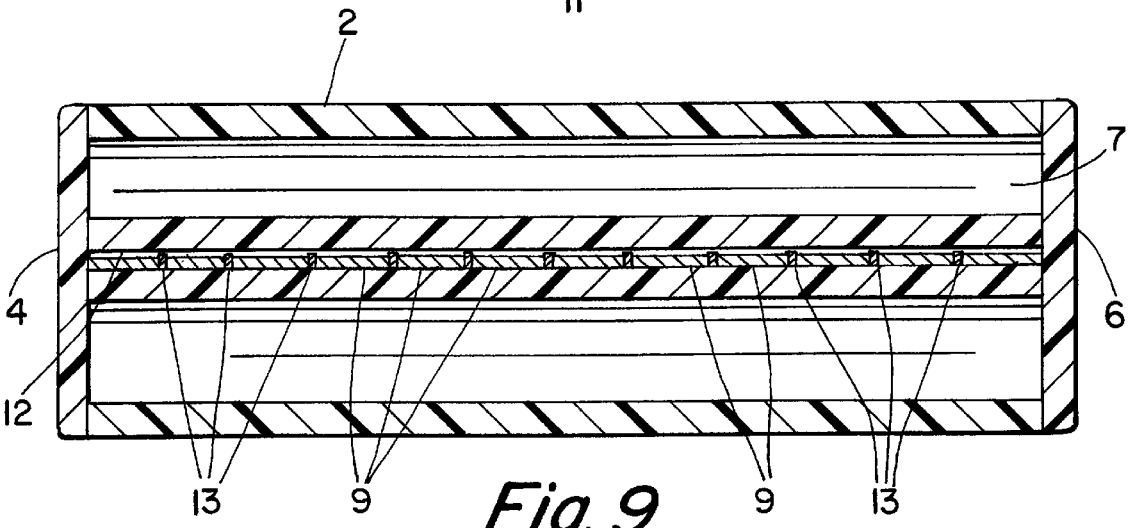
FIG. 9 is a sectional view taken along line 9—9 of FIG. 6.

An alternate embodiment of the present invention is shown in FIGS. 5 and 9. In the alternate embodiment a plurality of spacers 13 are connected to the second grip such that each blade 9 is positioned between either two spacers 13 or a spacer 13 and the first or second end members 4 or 6. The spacers 13 assist in stabilizing the blades 9 thus maintaining the cutting edges 11 in linear alignment. The alternate embodiment also includes blades 9 each having a engagement member 14 connected thereto and extending in angular relation therefrom. The first grip 2 defines an engagement channel 16 which coextends the first grip in substantially parallel relation to the backplate 7. Any shape or angulation of the engagement member 14 is contemplated by this invention. Preferably the engagement member 14 is formed by folding a portion of the blade 9 as is shown in FIGS. 6 and 7. By folding blade 9 in the manner shown in FIG. 6, the blade 9 can be inserted between the first and second grip 2 and 3 which will spread to accommodate the doubled thickness of blade 9. As the folded portion of blade 9 passes beneath the channel 16, the engagement member 14 snaps upward into the channel 16 while the first grip 2 is urged in pressed abutment with the planar body 17 of the blades 9, thus, limiting the extraction of the blades 9 from the case 1.

Whether the preferred or alternate embodiment is used, any attempt to remove the blades 9 from the case 1 will effectively disintegrate the continuous arrangement of cutting edges 11 thus destroying any practical use of the present invention as a tool for laceration. As the first grip 2 is an intricate component necessary to maintaining the alignment of the blades 9 and as first grip 2 is positioned in such close proximity to the actual cutting edges 11, any attempt to file either the first grip 2 or the second grip 3 to expose more of the blade 9 would effectively reduce the effective grip on the blades 9 thus destroying the integrity of the aligned blades 9 and their function as a continuous lacerating edge.

While I have shown my invention in two forms, it will be obvious to those skilled in the art that it is not so limited but is susceptible of various changes and modifications without departing from the spirit thereof.

What I claim is:

1. A disposable razor comprising:

(a) a plurality of disconnected blades, each blade defining a cutting edge and having an equal thickness and each disposed in coplanar arrangement with said cutting edges maintained in substantially linear alignment; and (b) means for securing said plurality of blades in coplanar arrangement with said cutting edges maintained in substantially linear alignment.

2. A disposable razor as defined in claim 1 wherein each of said plurality of blades comprises:

(a) a planar body defining said cutting edges; and (b) an engagement member connected to said planar body and extending therefrom in angular relation thereto.

3. A disposable razor as defined in claim 1 wherein said securing means compromises:

(a) an elongated first grip extending across said plurality of blades;

(b) an elongated second grip extending along said plurality of blades opposite said first grip; and (c) means connected to said first grip and said second grip for supporting said first grip and second grip in pressed abutment with said plurality of blades thus securing said plurality of blades in coplanar relation.

4. A disposable razor as defined in claim 3 wherein said support means comprises:

(a) a first end member connected to a first end of said first grip and a corresponding first end of said second grip; and (b) a second end member connected to a second end of said first grip and a corresponding second end of said second grip, wherein said first and second end members space said first and second grip a distance less than said thickness of each of said plurality of blades.

5. A disposable razor as defined in claim 3 further comprising a backplate connected to said first grip and said second grip in longitudinal coextension therewith for maintaining said plurality of edges in substantially linear alignment.

6. A disposable razor as defined in claim 2 wherein said securing means comprises:

(a) an elongated first grip extending along said plurality of blades;

(b) an elongated second grip extending along said plurality of blades opposite said first grip; and (c) means connected to said first and second grips for supporting said first grip and said second grip and pressed abutment with said plurality of blades thus securing said plurality of blades in coplanar relation.

7. A disposable razor as defined in claim 6 further comprising means for locking each said blade between said first grip and said second grip.

8. A disposable razor as defined in claim 7 wherein said locking means comprises an engagement channel defined by said first grip for receiving said engagement members thus locking said plurality of blades between said first grip and said second grip.

9. A disposable razor as defined in claim 3 further comprising a plurality of spacers connected to said second grip wherein each of said plurality of spacers is positioned between two of said plurality of blades to limit the lateral movement of said blades along said first and second grips.

10. A disposable razor comprising a plurality of disconnected blades each secured in coplanar arrangement by a case and defining a cutting edge wherein said case defines a slot in which said plurality of blades are received and secured.

11. A disposable razor as defined in claim 10 wherein said case comprises a first grip and a second grip spaced in parallel relation and partially defining said slot.

12. A disposable razor as defined in claim 11 further comprising a plurality of ridges formed on said first and second grips and extending longitudinally thereon in substantially parallel relation.

13. A disposable razor as defined in claim 11 further comprising an engagement channel defined by said first grip and partially defining said slot for receiving each of said plurality of blades to lock each said blade within said slot.

14. A disposable razor as defined in claim 11 wherein said case comprises a backplate against which said plurality of blades are abutted to maintain said cutting edges in substantially linear alignment.

15. A disposable razor as defined in claim 10 wherein each said blades comprises a planar body defining said cutting edge and an engagement member connected to said body and extending in angular relation thereto.

16. A disposable razor as defined in claim 13 wherein each said blade comprises a planar body defining said cutting edge and an engagement member connected to said body and extending in angular relation thereto, wherein each said engagement member is received within said engagement channel to lock said blades within said slot.

* * * * *